US012195259B2

(12) United States Patent
Ro et al.

(10) Patent No.: US 12,195,259 B2
(45) Date of Patent: Jan. 14, 2025

(54) HANGING PACKAGE STRUCTURE

(71) Applicant: Samsung Electronics Co., Ltd., Gyeonggi-do (KR)

(72) Inventors: Chanyoung Ro, Gyeonggi-do (KR); Jinhyuk Ahn, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 65 days.

(21) Appl. No.: 18/200,672

(22) Filed: May 23, 2023

(65) Prior Publication Data

US 2023/0286721 A1 Sep. 14, 2023

Related U.S. Application Data

(63) Continuation of application No. PCT/KR2021/017966, filed on Dec. 1, 2021.

(30) Foreign Application Priority Data

Dec. 28, 2020 (KR) ..... 10-2020-0184353

(51) Int. Cl.

| | |
|---|---|
| ***B65D 77/04*** | (2006.01) |
| ***B65D 1/36*** | (2006.01) |
| ***B65D 5/02*** | (2006.01) |
| ***B65D 25/10*** | (2006.01) |

(Continued)

(52) U.S. Cl.

CPC ..... *B65D 77/0433* (2013.01); *B65D 1/36* (2013.01); *B65D 5/0254* (2013.01); *B65D 25/10* (2013.01); *B65D 25/22* (2013.01); *B65D 85/30* (2013.01)

(58) Field of Classification Search

CPC ..... B65D 1/36; B65D 5/02; B65D 5/0254; B65D 5/20; B65D 5/38; B65D 5/42; B65D 5/50; B65D 5/54; B65D 25/10; B65D 25/22; B65D 75/34; B65D 75/36;

(Continued)

(56) References Cited

U.S. PATENT DOCUMENTS

| | | | | |
|---|---|---|---|---|
| 4,754,879 A * | 7/1988 | Benno | ..... | B65D 5/28 206/427 |
| 8,944,312 B2 | 2/2015 | Won et al. | | |
| 8,997,388 B1 | 4/2015 | Frost | | |

(Continued)

FOREIGN PATENT DOCUMENTS

| | | | | |
|---|---|---|---|---|
| DE | 2013008189 U1 * | 1/2015 | ..... | B65D 75/36 |
| JP | 7-277342 A | 10/1995 | | |

(Continued)

OTHER PUBLICATIONS

Hanging Tray (Year: 2015).*

*Primary Examiner* — Bryon P Gehman
(74) *Attorney, Agent, or Firm* — Cha & Reiter, LLC

(57) ABSTRACT

A package structure is disclosed herein, including: a case having a first surface, second surface and side surfaces, and a tray housed within a space defined by the case, the tray including: a first part on which a product is disposable, a second part extending from the first part at least partly facing the first surface, a hanger part extending from the second part outwards from the case through an opening, the case further including third, fourth, fifth and sixth surfaces, and an extension portion facing a second part of the tray disposed partly between the extension portion and the first surface.

20 Claims, 10 Drawing Sheets

(51) Int. Cl.
*B65D 25/22* (2006.01)
*B65D 85/30* (2006.01)

(58) Field of Classification Search
CPC .... B65D 75/52; B65D 77/04; B65D 77/0433; B65D 85/30
USPC ..... 206/557–565, 806
See application file for complete search history.

(56) References Cited

U.S. PATENT DOCUMENTS

| | | | | |
|---|---|---|---|---|
| 9,123,262 | B1 | 9/2015 | Frost | |
| 10,450,101 | B2 | 10/2019 | Bressan et al. | |
| 10,647,468 | B2 | 5/2020 | Frost | |
| 10,696,443 | B1 | 6/2020 | Mundt et al. | |
| 11,001,430 | B2 * | 5/2021 | Stewart | B65D 75/525 |
| 2012/0153014 | A1 | 6/2012 | Won et al. | |
| 2017/0247136 | A1 | 8/2017 | Frost | |
| 2019/0119021 | A1 * | 4/2019 | Baker | B65D 75/5855 |
| 2019/0127108 | A1 | 5/2019 | Bressan et al. | |
| 2019/0343301 | A1 | 11/2019 | Frost | |
| 2021/0280092 | A1 | 9/2021 | Sundholm | |
| 2022/0219860 | A1 * | 7/2022 | Haefliger | B65D 5/2057 |
| 2022/0340325 | A1 | 10/2022 | Frost | |

FOREIGN PATENT DOCUMENTS

| | | | |
|---|---|---|---|
| JP | 9-142531 | A | 6/1997 |
| JP | 2000-7024 | A | 1/2000 |
| KR | 20-0338642 | Y1 | 1/2004 |
| KR | 10-2012-0068262 | A | 6/2012 |
| KR | 10-1501604 | B1 | 3/2015 |
| KR | 10-1592826 | B1 | 2/2016 |
| WO | 2018/162799 | A1 | 9/2018 |

* cited by examiner

HANGING PACKAGE STRUCTURE

CROSS-REFERENCE TO RELATED APPLICATION(S)

This application is a continuation of International Application No. PCT/KR2021/017966, which was filed on Dec. 1, 2021, and claims priority to Korean Patent Application No. 10-2020-0184353, filed on Dec. 28, 2020, in the Korean Intellectual Property Office, the disclosures of which are incorporated by reference herein their entirety.

TECHNICAL FIELD

Embodiments disclosed herein relate to packaging, and more particular, to packaging for a product that reduces wasted space caused by accommodating display on a hanger.

BACKGROUND

Various electronic products such as electronic devices, smartphone accessories and electronic stylus pens are often sold with diverse forms of packaging. Packaging may protect products disposed therein from external shocks that may occur during transportation, retail and sales. Further, packaging often includes a hanger that is designed according to a specified standard, so that multiple items of the product can be hung neatly on a sales rack for display and sale.

SUMMARY

Some forms of packaging use a structure in which a hole is drilled into an upper surface of a case forming an outer surface of the package. Then, a hanger part is passed through the hole, which completes assembly of the packaging. In this case, even though a width of a product is smaller than a width of the hanger part, unnecessary spaces may be formed on both sides of the hanger part to permit the hanger part to be supported by an upper end of the case.

Certain embodiments disclosed herein provide a package structure in which a size of the hanger part of the tray is set accordingly to the size of the case, which may reduce the creation of unnecessary spaces in the packaging.

Certain embodiments disclosed herein may provide a package structure in which a portion of an upper end of the case may support a portion of the tray.

According to certain embodiments, a package structure is disclosed herein, including: a case including a first surface in which a first opening is formed, a second surface facing the first surface, and side surfaces surrounding an inner space defined between the first surface and the second surface and connected to the first surface and the second surface, and a tray at least partially housed within the inner space of the case, wherein the tray includes: a first part on which a product is disposed, a second part extending from the first part, the second part at least partially facing the first surface of the case, and a hanger part extending from the second part and extending outwards from the case through the first opening, wherein the case further includes: a third surface connecting the first surface and the second surface, a fourth surface extending from the third surface, a fifth surface extending from the third surface in a direction opposite to the fourth surface, a sixth surface extending from the fifth surface in a direction opposite to the third surface, and disposed between the fourth surface and the fifth surface, an extension portion extending from the sixth surface and at least partially facing the second part of the tray, and wherein the second part of the tray is disposed at least partially between the extension portion and the first surface.

Further, a case accommodating a hanger tray according to certain embodiments of the disclosure may include a first side surface, a second side surface facing the first side surface, a third side surface disposed between the first side surface and the second side surface, a fourth side surface disposed between the first side surface and the second side surface and facing the third surface, a first cover extending from one distal end of the first side surface and covering at least a portion of a first opening defined by the first side surface, the second side surface, the third side surface, and the fourth side surface, a second cover extending from the other distal end of the first side surface, as defined by the first side surface, the second side surface, the third side surface, and the fourth side surface, and covering at least a portion of a second opening formed at a position opposite to the first opening, and a third cover that extends from one distal end of the second side surface and is disposed at a position facing the first cover, in which the case surrounds the hanger tray.

According to embodiments disclosed in the disclosure, unnecessary space formation in packaging structure may be reduced, thereby reducing logistical and material costs.

According to embodiments disclosed in the disclosure, a tray and a case may be more firmly coupled together, which may better prevent product from escaping the packaging unintentionally.

According to embodiments disclosed in the disclosure, the tray may be more easily separated from the case.

In addition, various effects directly or indirectly identified though the present specification may be provided.

BRIEF DESCRIPTION OF THE DRAWINGS

In connection with the description of the drawings, the same or similar components may be designated by the same or similar reference numerals.

DETAILED DESCRIPTION

Hereinafter, certain embodiments of the disclosure will be described with reference to the accompanying drawings. However, it should be understood that the disclosure is not limited to specific embodiments and includes various modifications, equivalents, and/or alternatives of the embodiments of the disclosure.

Figure 1:
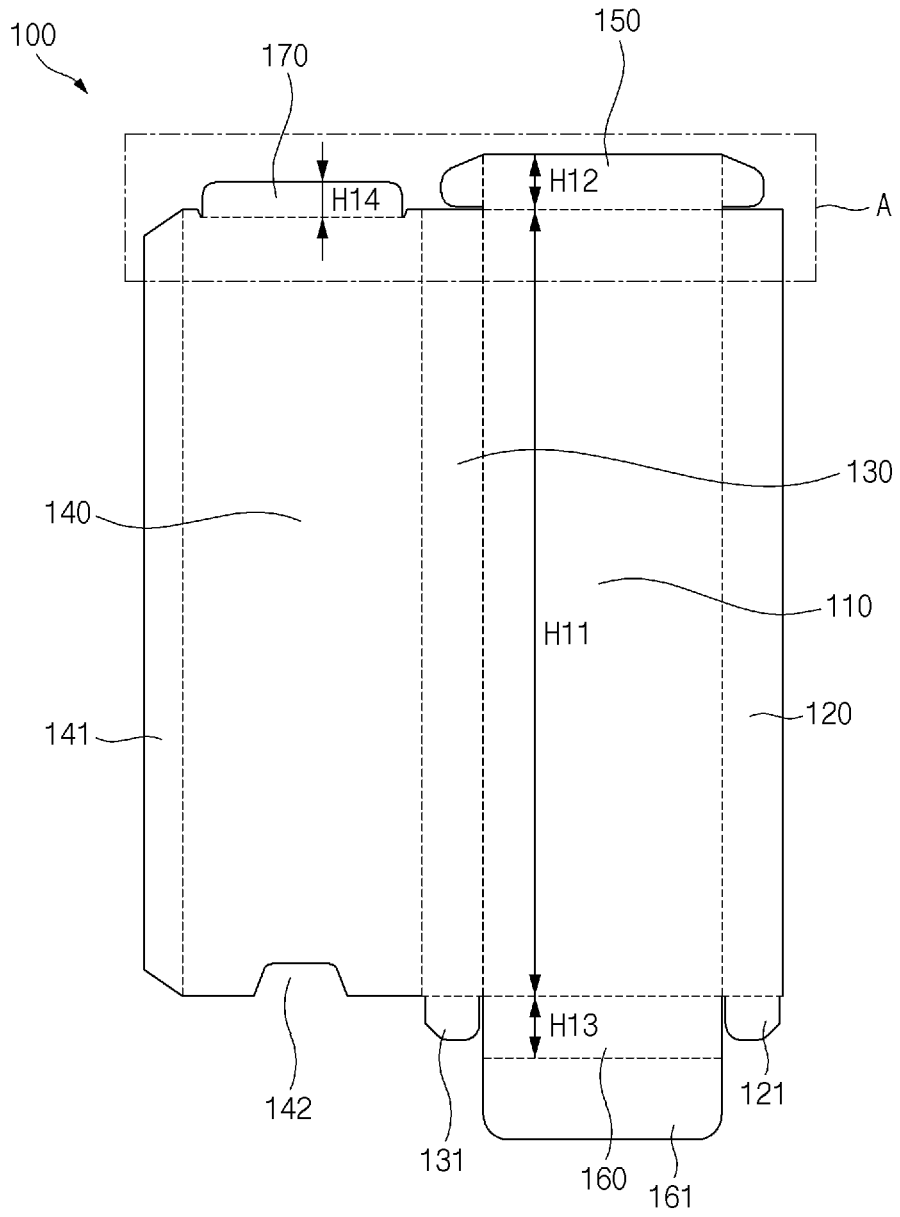
FIG. 1 is a plan view illustrating a state in which a case having a package structure according to an embodiment is unfolded.
Figure 2:
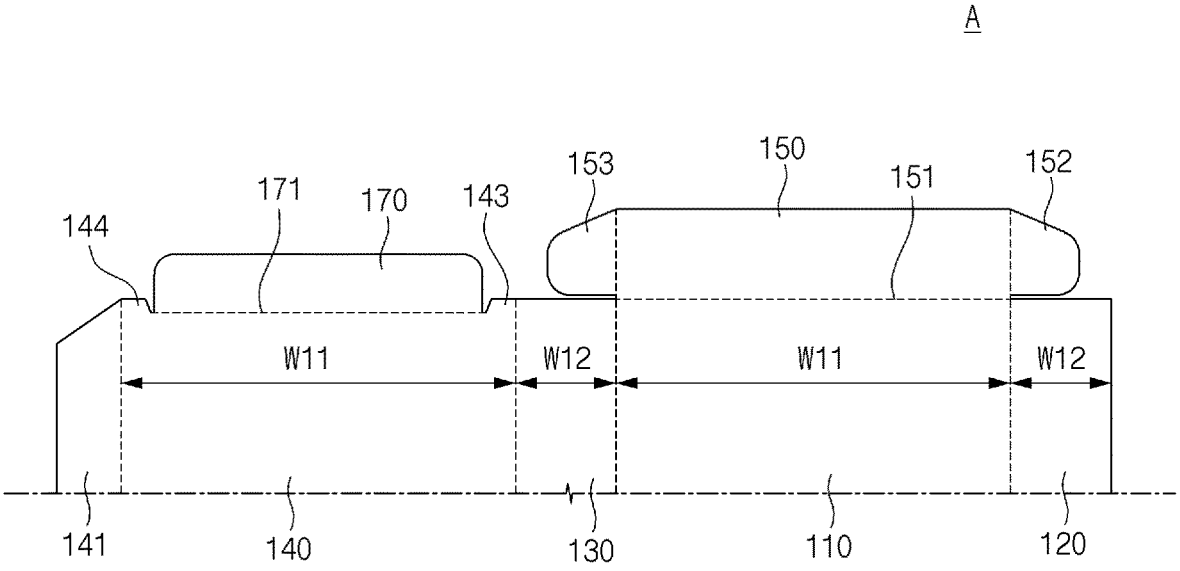
FIG. 2 is an enlarged view of part A of FIG. 1.
Figure 3:
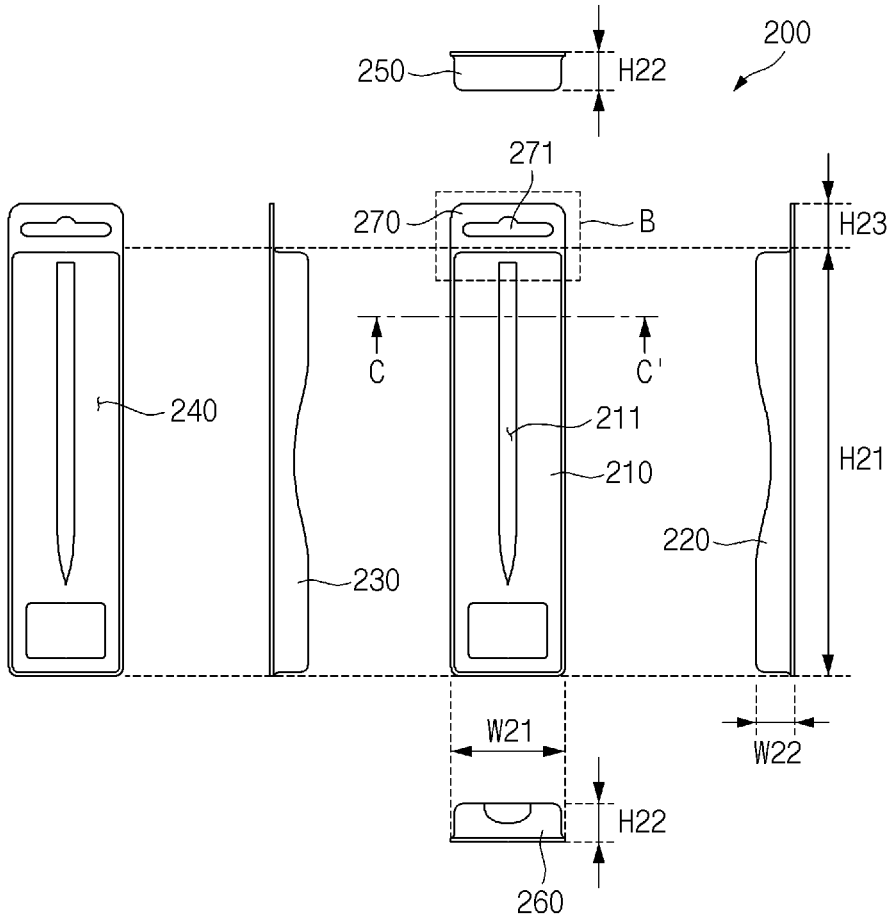
FIG. 3 is a plan view illustrating a tray having a package structure according to the embodiment when viewed from four surfaces.
Figure 4A:
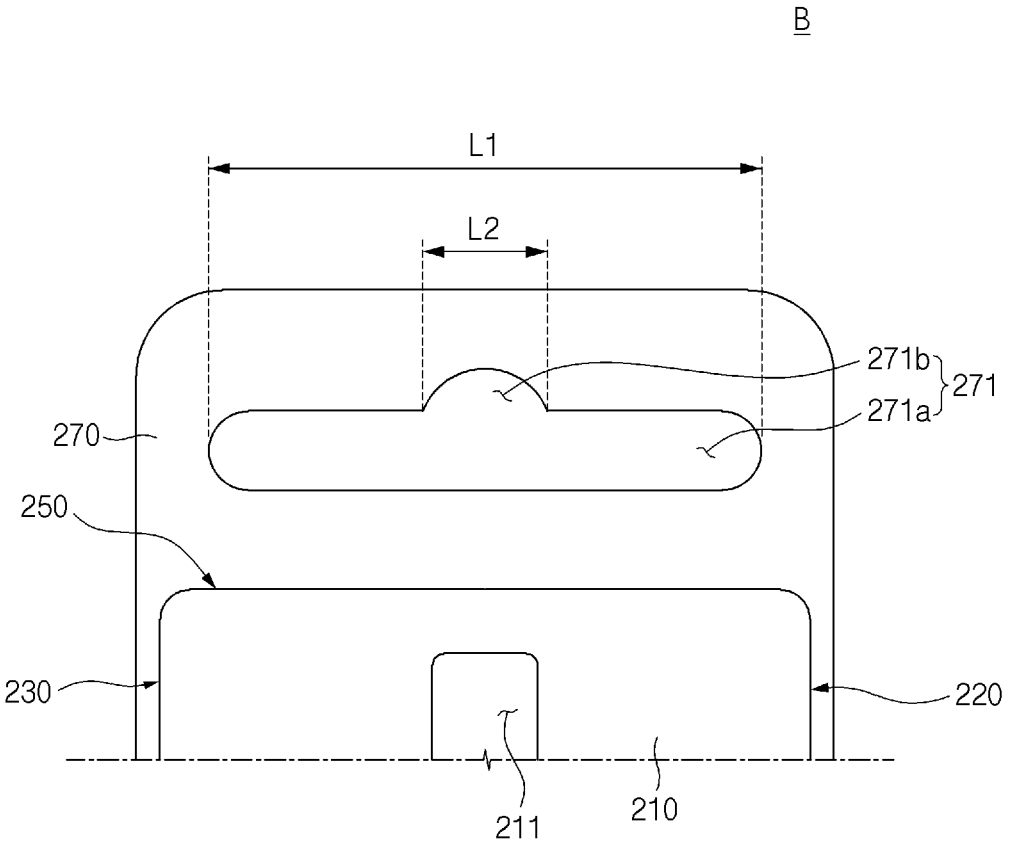
FIG. 4A is an enlarged view of part B of FIG. 3.
Figure 4B:
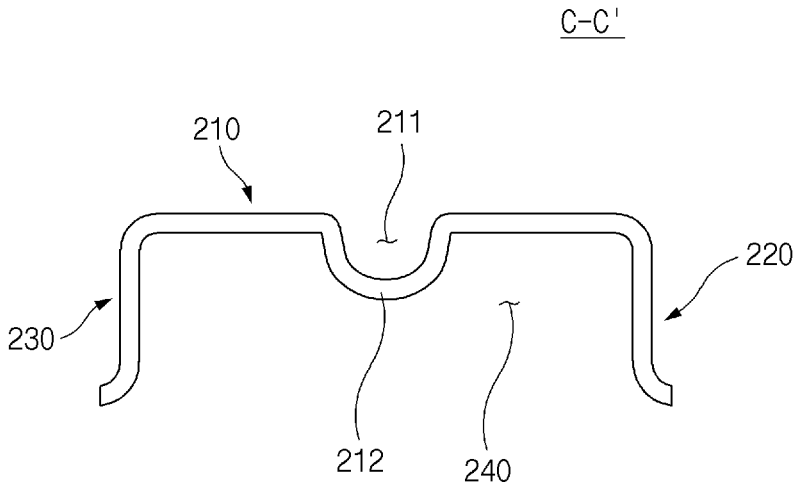
FIG. 4B is a view illustrating a cross section along line C-C' of FIG. 3.
Figure 5:
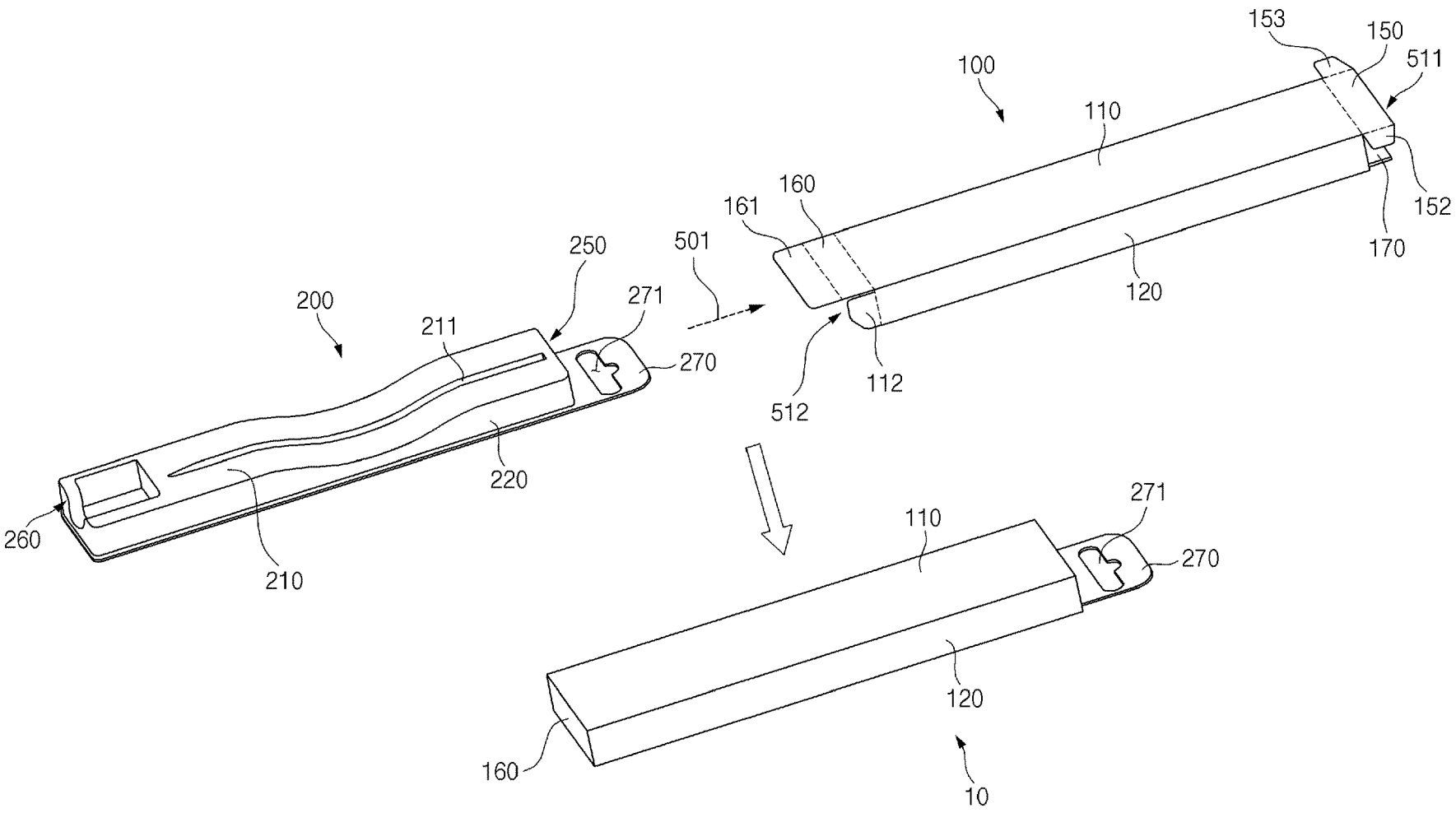
FIG. 5 is a perspective view illustrating the package structure according to the embodiment.

FIG. 1 is a plan view illustrating a state in which a case having a package structure according to an embodiment is unfolded. FIG. 2 is an enlarged view of part A of FIG. 1. FIG. 3 is a plan view illustrating a tray having a package structure according to the embodiment when viewed from four surfaces. FIG. 4A is an enlarged view of part B of FIG. 3. FIG. 4B is a view illustrating a cross section along line C-C' of FIG. 3. FIG. 5 is a perspective view illustrating the package structure according to the embodiment.

Referring to FIGS. 1 to 5, a package structure 10 may include a case 100 and a tray 200. For example, the case 100 may include an inner space formed by a plurality of surfaces. The case 100 may include a first surface (such as, for example, a fifth case surface 150) in which a first opening 511 is formed, a second surface (such as, for example, a sixth case surface 160) facing the first surface, and side surfaces (such as, for example, a first case surface 110, a second case surface 120, a third case surface 130, and the fourth case surface 140) surrounding the inner space between the first surface and the second surface and connected to the first surface and the second surface. The tray 200 on which a product (such as, for example, an electronic device, a smartphone accessory, and an electronic stylus pen) is seated may be at least partially disposed within the inner space of the case 100. When the tray 200 is disposed in the inner space of the case 100, at least a portion (such as, for example, a hanger part 270) of the tray 200 may be exposed to the outside of the case 100.

According to an embodiment, at least a portion (such as, for example, a body) of the tray 200 may be disposed within the case 100. For example, the case 100 may be formed so as to have a hexahedral shape including the first case surface 110 (such as, for example, a third surface or a first side surface), the second case surface 120 (such as, for example, a fourth surface or a third side surface), the third case surface 130 (such as, for example, a fifth surface or a fourth side surface), the fourth case surface 140 (such as, for example, a sixth surface or a second side surface), the fifth case surface 150 (such as, for example, the first surface or a first cover), and the sixth case surface 160 (such as, for example, the second surface or a second cover). The first case surface 110, the second case surface 120, the third case surface 130, and the fourth case surface 140 may form the side surfaces of the case 100. The fifth case surface 150 may form an upper surface of the case 100. The sixth case surface 160 may form a lower surface of the case 100. The case 100 may define the inner space, formed via being surrounded by the first case surface 110, the second case surface 120, the third case surface 130, and the fourth case surface 140. The first opening 511 may be formed disposed in a direction originating from the inner space and moving toward the fifth case surface 150. A second opening 512 may be formed disposed in a direction originating from the inner space and moving toward the sixth case surface 160. Before the fifth case surface 150 and the sixth case surface 160 are closed by a closing action directed toward the inner space, the tray 200 may be inserted into the second opening 512 in a direction of a first arrow 501. A portion (such as, for example, a body) of the tray 200 may be accommodated in the inner space of the case 100, and the other portion (such as, for example, the hanger part 270) of the tray 200 may be exposed to the outside of the case 100 through the first opening 511.

According to an embodiment, in FIGS. 1 and 2, the case 100 may include a plurality of surfaces defining the inner space. For example, the plurality of surfaces may be manufactured as one continuous flat surface. FIG. 1 is a plan view in which the plurality of surfaces are unfolded. The first case surface 110, the second case surface 120, the third case surface 130, the fourth case surface 140, the fifth case surface 150, and the sixth case surface 160 may be folded along dotted lines of FIG. 1 so as to form six surfaces of the case 100. As an example, the second case surface 120, the third case surface 130, the fifth case surface 150, and the sixth case surface 160 may extend from different corners of the first case surface 110. The fourth case surface 140 may extend from the third case surface 130 in a direction opposite to the first case surface 110.

According to an embodiment, a first wing portion 141 may extend from the fourth case surface 140 in a direction opposite to the third case surface 130. When the case 100 is configured as a hexahedron, the first wing portion 141 may overlap and be attached to the second case surface 120.

According to an embodiment, a second wing portion 121 may extend from the second case surface 120 in parallel to the sixth case surface 160. A third wing portion 131 may extend from the third case surface 130 in parallel to the sixth case surface 160. When the case 100 is configured as a hexahedron, the second wing portion 121 and the third wing portion 131 may be folded toward the second opening 512.

According to an embodiment, the fifth case surface 150 may include at least one wing portion (such as, for example, a fourth wing portion 152 and a fifth wing portion 153). The fourth wing portion 152 may extend from the fifth case surface 150 in parallel to the second case surface 120. The fifth wing portion 153 may extend from the fifth case surface 150 in parallel to the third case surface 130. When the case 100 is configured as a hexahedron, the fourth wing portion 152 and the fifth wing portion 153 may be folded toward the first opening 511.

According to an embodiment, a sixth wing portion 161 may extend from the sixth case surface 160 in a direction opposite to the first case surface 110. When the case 100 is configured as a hexahedron, the sixth wing portion 161 may be folded toward the second opening 512. When the case 100 and the tray 200 are coupled, the sixth wing portion 161 may be inserted between the fourth case surface 140 and the tray 200. In this case, the sixth wing portion 161 may be disposed so as to overlap the fourth case surface 140. The fourth case surface 140 may include an opening portion 142 defined in a portion that overlaps the sixth wing portion 161. For example, in a state in which the case 100 and the tray 200 are coupled, a user may open the sixth wing portion 161 using a tool or a body portion (such as, for example, their fingernail) through the opening portion 142 and may thus pull the tray 200 towards a direction of the second opening 512.

According to an embodiment, as illustrated in FIGS. 3, 4A, and 4B, the tray 200 may include a first part (such as, for example, a first body portion 210) on which a product is seated, a second part (such as, for example, a fourth body portion 250) extending from the first part and at least partially facing the fifth case surface 150 (such as, for example, the first surface) of the case 100, and the hanger part 270 extending from the second part and extending outward from the case 100 through the first opening 511 of the case 100. For example, the tray 200 may include the body and the hanger part 270. The body may include the first body portion 210 (such as, for example, the first part), a second body portion 220 (such as, for example, a third part), a third body portion 230 (such as, for example, a fourth part), a fourth body portion (such as, for example, the second part), and a fifth body portion 260 (such as, for example, a fifth part). As an example, the body may be formed via an injection molding method. The first body portion 210, the second body portion 220, the third body portion 230, the fourth body portion 250, and the fifth body portion 260 may define a first recess 240. The first body portion 210 may partially include a recess structure 212. A second recess 211 may be formed by the recess structure 212. The second recess 211 may be formed according to the shape of a product accommodated in the package structure 10. The hanger part 270 may extend from the fourth body portion 250 in a direction opposite to the first body portion 210 in parallel to the first body portion 210.

According to an embodiment, when the tray 200 is accommodated in the case 100, the body of the tray 200 may be disposed so as to face each surface of the case 100. For example, the first body portion 210 may face the first case surface 110. The second body portion 220 may face the second case surface 120. The third body portion 230 may face the third case surface 130. The fourth body portion 250 may face the fifth case surface 150. The fifth body portion 260 may face the sixth case surface 160.

According to an embodiment, in the case 100, the first case surface 110, the second case surface 120, the third case surface 130, and the fourth case surface 140 may be formed so as to have a first height H11. The fifth case surface 150 may be formed to have a second height H12. The sixth case surface 160 may be formed to have a third height H13. The second height H12 may be smaller than the third height H13. The first case surface 110, the fourth case surface 140, the fifth case surface 150, and the sixth case surface 160 may be formed to have a first width W11. The second case surface 120 and the third case surface 130 may be formed to have a second width W12. The second width W12 may be equal to the third height H13.

According to an embodiment, in FIG. 2, an extension portion 170 (such as, for example, a third cover) may be formed at a corner of the fourth case surface 140, which is adjacent to the fifth case surface 150. For example, at least one protrusion portions 143 and 144 may be formed on both sides of the extension portion 170. The extension portion 170 may be disposed within the fourth case surface 140 from the protrusion portions 143 and 144 by a size of the protrusion portions 143 and 144. A width of the extension portion 170 may be smaller than the width (such as, for example, the first width W11) of the fourth case surface 140 by the size of the protrusion portions 143 and 144. The extension portion 170 may have a fourth height H14. The fourth height H14 may be smaller than the second height H12. A bending line 171 (or a folding line) may be formed in advance at a folded corner between the extension portion 170 and the fourth case surface 140.

According to an embodiment, in FIG. 3, in the tray 200, the first body portion 210, the second body portion 220, and the third body portion 230 may be formed to have a fifth height H21. The fourth body portion 250 and the fifth body portion 260 may be formed to have a sixth height H22. The fifth height H21 may be smaller than or be equal to the first height H11. The sixth height H22 may be smaller than or equal to the third height H13. The first body portion 210, the fourth body portion 250, and the fifth body portion 260 may have a third width W21. The second body portion 220 and the third body portion 230 may have a fourth width W22. The third width W21 may be smaller than or equal to the first width W11. The fourth width W22 may be smaller than or equal to the second width W12. The fourth width W22 may be equal to the sixth height H22.

According to an embodiment, the hanger part 270 may extend from the fourth body portion 250. For example, the hanger part 270 may have a seventh height H23 and the third width W21. The hanger part 270 may include a hanger hole 271. As an example, the hanger hole 271 may be formed according to certain standard specifications for such holes, for use in retail. The hanger hole 271 may include a first hanger hole 271*a* corresponding to two hanger hooks and a second hanger hole 271*b* corresponding to one hanger hook. The second hanger hole 271*b* may be formed at a central portion of the first hanger hole 271*a*. The first hanger hole 271*a* may have a first length L1 corresponding to the standard specifications. The second hanger hole 271*b* may have a second length L2 corresponding to the standard specifications. The width (such as, for example, the third width W21) of the hanger part 270 may be greater than the first length L1. As an example, the width (such as, for example, the third width W21) of the hanger part 270 may be determined according to the size (such as, for example, the first length L1) of the first hanger hole 271*a*, and the width of the tray 200 may be greater than or equal to the width of the hanger part 270.

Figure 6:
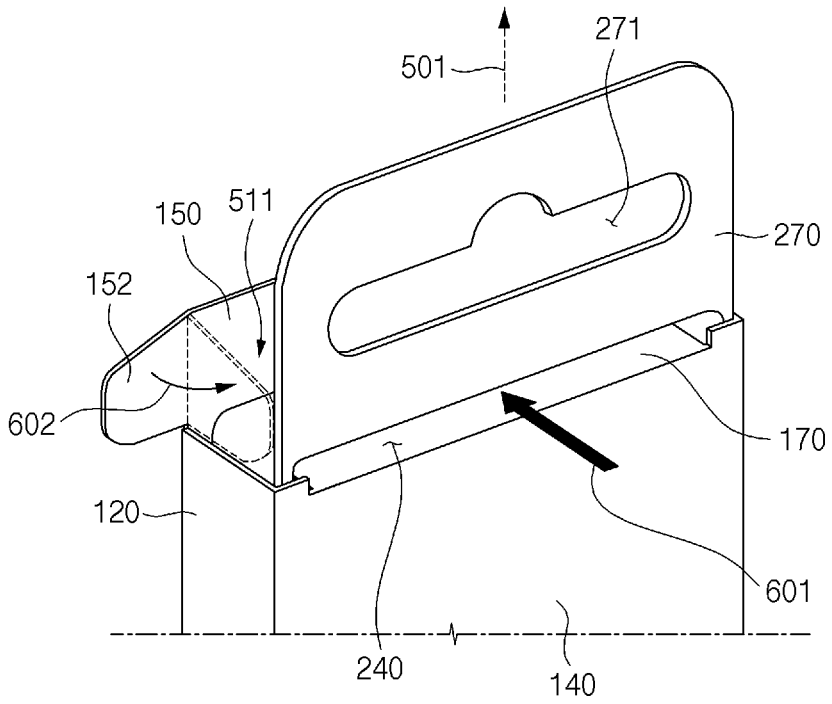
FIG. 6 is a view illustrating a process of coupling the case and the tray in the package structure according to the embodiment.
Figure 7:
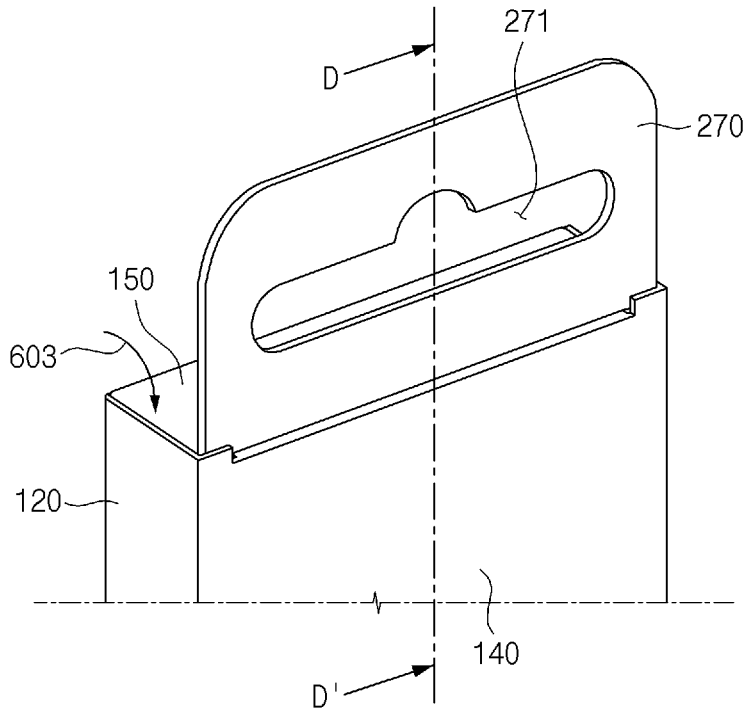
FIG. 7 is a view illustrating a state after the case and the tray are coupled in the package structure according to the embodiment.
Figure 8:
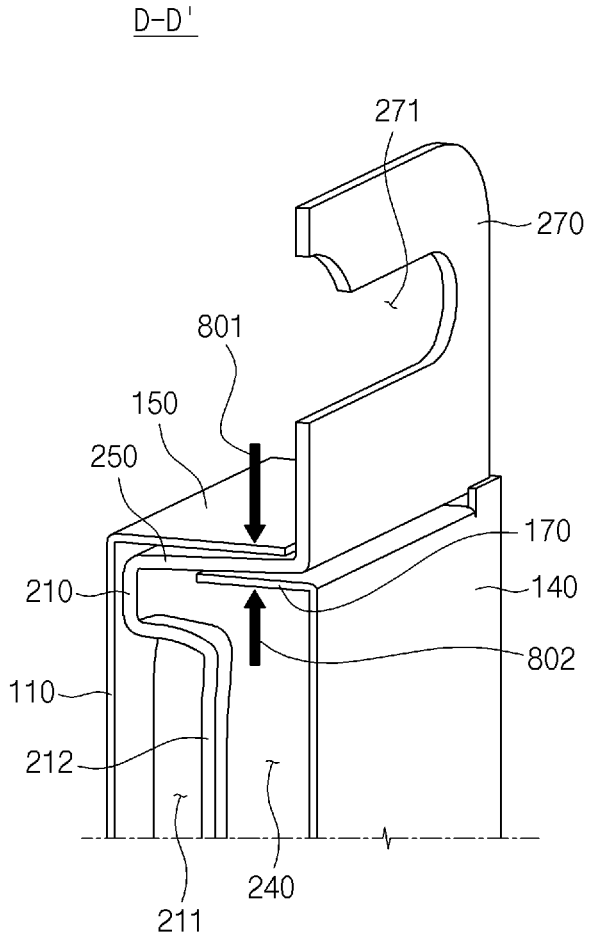
FIG. 8 is a view illustrating a cross section along line D-D' of FIG. 7.

FIG. 6 is a view illustrating a process of coupling the case and the tray in the package structure according to the embodiment. FIG. 7 is a view illustrating a state after the case and the tray are coupled in the package structure according to the embodiment. FIG. 8 is a view illustrating a cross section along line D-D' of FIG. 7.

Referring to FIGS. 6 to 8, as illustrated in FIG. 5, the body of the tray 200 may be seated on the inner space of the case 100. The hanger part 270 of the tray 200 may be exposed to the outside of the case 100 through the first opening 511.

According to an embodiment, the extension portion 170 may be folded toward a first recess 240 (such as, for example, along a first arrow 601) by a specified angle (such as, for example, 90 degrees). The extension portion 170 may be inserted into the first recess 240 While the extension portion 170 is inserted into the first recess 240, the extension portion 170 may face the fourth body portion 250 and may support the fourth body portion 250 in a direction toward the hanger part 270.

According to an embodiment, the fourth wing portion 152 may be folded toward the fifth case surface 150 (such as, for example, along a second arrow 602) by a specified angle. Although not illustrated, like the fourth wing portion 152, the fifth wing portion 153 may also be folded toward the fifth case surface 150 according to a specified angle. In a state in which the fourth wing portion 152 and the fifth wing portion 153 are folded, the fifth case surface 150 may be folded toward the first opening 511. When folded in this way, the fifth case surface 150 may face the fourth body portion 250, the fourth wing portion 152 may be inserted between the second case surface 120 and the second body portion 220, and the fifth wing portion 153 may be inserted between the third case surface 130 and the third body portion 230.

According to an embodiment, the tray 200 may be fixed by the case 100. For example, in FIG. 8, the fourth body portion 250 of the tray 200 may be disposed between the fifth case surface 150 and the extension portion 170 of the case 100. The fifth case surface 150 may support the fourth body portion 250 in a direction of a third arrow 801. The extension portion 170 may support the fourth body portion 250 in a direction of a fourth arrow 802. Thus, the body of the tray 200 may be fixed inside the case 100.

As described above, the extension portion 170 of the case 100 together with the fifth case surface 150 of the case 100 may support the fourth body portion 250 of the tray 200.

Accordingly, when the hanger part 270 is hung on an external hanger, the case 100 and the tray 200 may be stably fixed so as to secure and protect a product housed therein. Further, the extension portion 170 of the case 100 may prevent a product accessory stored in the first recess 240 (such as, for example, a user manual, a stylus, etc.) from separation or becoming unsecured within the packaging.

Figure 9:
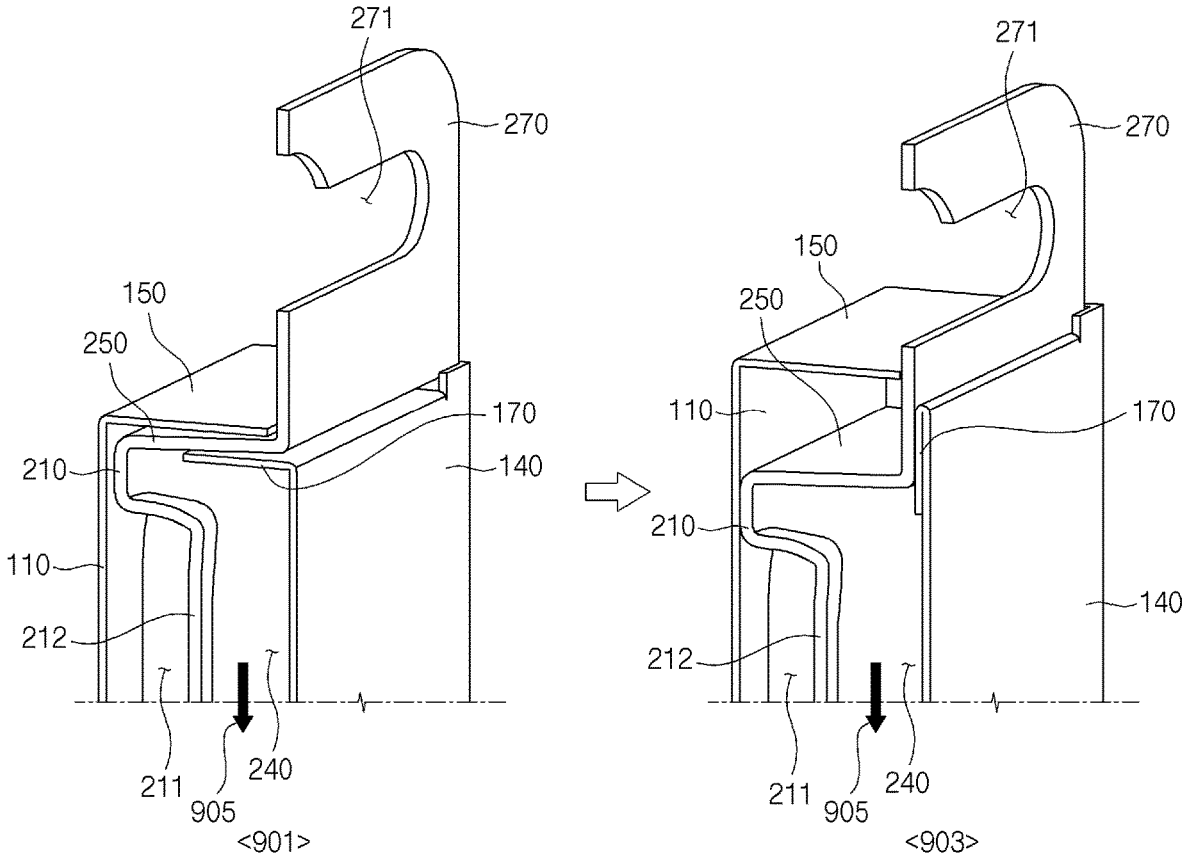
FIG. 9 is a view illustrating a process of separating the tray from the case in a state in which the case and the tray are coupled according to the embodiment.

FIG. 9 is a view illustrating a process of separating the tray from the case in a state in which the case and the tray are coupled according to the embodiment.

Referring to FIG. 9, the tray 200 may be separated from the case 100 by the user. For example, a first state 901 may depict a state before the tray 200 is separated from the case 100. A second state 903 may depict a state in which the tray 200 is actively being separated from the case 100.

According to an embodiment, in the first state 901, the fourth body portion 250 of the tray 200 may be disposed between the fifth case surface 150 and the extension portion 170 of the case 100. The extension portion 170 may face the fourth body portion 250. In this case, the tray 200 may be moved by the user in a direction of an arrow 905. For example, the user may pull the tray 200 in the direction of the arrow 905 to separate the case 100 and the tray 200. In the second state 903, the tray 200 may move in the direction of the arrow 905, and the fourth body portion 250 may accordingly move away from the fifth case surface 150. In this case, the extension portion 170 may be folded toward the fourth case surface 140 and face the fourth case surface 140. Further, the extension portion 170 may face the hanger part 270. In a state in which the extension portion 170 faces the fourth case surface 140 and the hanger part 270, the tray 200 may continuously move in the direction of the arrow 905 as the user pulls on the same, and may eventually thus be separated from the case 100.

According to an embodiment, the bending line 171 (or the folding line) may be formed in advance at a folded corner between the extension portion 170 and the fourth case surface 140 (such as, for example, the sixth surface). An corner between the extension portion 170 and the fourth case surface 140 may include a folding assist line so that the extension portion 170 overlaps the fourth case surface 140 when the tray 200 is moved in a direction (such as, for example, the direction of the arrow 905) toward the sixth case surface 160 (such as, for example, the second surface) of the case 100 by a specified force or more.

According to an embodiment, the height (such as, for example, the fourth height H14) of the extension portion 170 may be determined so that the extension portion 170 is not in contact with the recess structure 212 when being folded.

As described above, when the tray 200 is moved in the direction of the arrow 905 by a specified force or more, the extension portion 170 may be folded to overlap the fourth case surface 140, and accordingly, the user may easily separate the tray 200 from the case 100 without an additional operation.

According to certain embodiments, a package structure (such as, for example, the package structure 10) may include a case (such as, for example, the case 100) including a first surface (such as, for example, the fifth case surface 150) in which a first opening (such as, for example, the first opening 511) is formed, a second surface (such as, for example, the sixth case surface 160) facing the first surface, and side surfaces (such as, for example, the first case surface 110, the second case surface 120, the third case surface 130, or the fourth case surface 140) surrounding an inner space between the first surface and the second surface and connected to the first surface and the second surface; and a tray (such as, for example, the tray 200) at least partially disposed within the inner space of the case. The tray may include a first part (such as, for example, the first body portion 210) on which a product is seated, a second part (such as, for example, the fourth body portion 250) extending from the first part and at least partially facing the first surface of the case, and a hanger part (such as, for example, the hanger part 270) extending from the second part, outward from the case through the first opening. The case may further include a third surface (such as, for example, the first case surface 110) connecting the first surface and the second surface, a fourth surface (such as, for example, the second case surface 120) extending from the third surface, a fifth surface (such as, for example, the third case surface 130) extending from the third surface in a direction opposite to the fourth surface, a sixth surface (such as, for example, the fourth case surface 140) extending from the fifth surface in a direction opposite to the third surface and disposed between the fourth surface and the fifth surface, and an extension portion (such as, for example, the extension portion 170) extending from the sixth surface and at least partially facing the second part of the tray. The second part of the tray may be disposed at least partially between the extension portion and the first surface.

According to certain embodiments, when the second surface of the case is open and the tray moves in a direction toward the second surface of the case, the extension portion of the case may be further folded so as to overlap with the sixth surface of the case.

According to certain embodiments, a corner between the extension portion of the case and the sixth surface of the case may include a bending line (such as, for example, the bending line 171) so that the extension portion of the case overlaps the sixth surface of the case when the tray is moved in a direction toward the second surface of the case (e.g., by a specified force or more).

According to certain embodiments, the sixth surface of the case may include at least one protrusion portion (such as, for example, the protrusion portions 143 and 144) on one side of a corner between the extension portion of the case and the sixth surface of the case.

According to certain embodiments, the case may further include a wing portion (such as, for example, the sixth wing portion 161). The wing portion may extend from the sixth surface in a direction opposite to the fifth surface. The wing portion may overlap with the fourth surface, and be at least partly attached to the fourth surface.

According to certain embodiments, the fourth surface of the case may include an opening portion (such as, for example, the opening portion 142) in a portion thereof overlapping the wing portion.

According to certain embodiments, the hanger part may include a first hanger hole (such as, for example, the first hanger hole 271*a*) formed with respect to two hangers according to the standard specification (e.g., for retail), and a second hanger hole (such as, for example, the second hanger hole 271*b*) formed with respect to one hanger according to the standard specification.

According to certain embodiments, a width (such as, for example, the third width W21) of the hanger part may be determined according to a size (such as, for example, the first length L1) of the first hanger hole. A width (such as, for example, the third width W21) of the tray may be determined to be greater than or equal to a width of the hanger part.

According to certain embodiments, the hanger part may extend from the second part of the tray in parallel to the first part of the tray.

According to certain embodiments, the tray may further include a third part (such as, for example, the second body portion 220) facing the second surface of the case, a fourth part (such as, for example, the third body portion 230) facing the fourth surface of the case, and a fifth part (such as, for example, the fifth body portion 260) facing the fifth surface of the case. The first part of the tray may face the third surface of the case.

According to certain embodiments, the tray may form a first recess (such as, for example, the first recess 240) through the first part, the second part, the third part, the fourth part, and the fifth part. The extension portion of the case may be folded from the sixth surface to be inserted into the first recess.

According to certain embodiments, the third part of the tray may include a recess structure (such as, for example, the recess structure 212) forming a second recess (such as, for example, the second recess 211) on which the product is seated. When the tray moves in a direction toward the second surface of the case, and when the extension portion of the case is folded toward the sixth surface of the case, a size of the extension portion of the case may such that the extension portion of the case and the recess structure do not contact with each other.

According to certain embodiments, the tray may accommodate an electronic device in the second recess.

According to certain embodiments, the case may further include a first wing portion (such as, for example, the fourth wing portion 152) extending from the first surface in a direction toward the fourth surface, and a second wing portion (such as, for example, the fifth wing portion 153) extending from the first surface in a direction toward the fifth surface. The first wing portion of the case may be inserted between the fourth surface of the case and the third portion part of the tray. The second wing portion of the case may be inserted between the fifth surface of the case and the fourth part of the tray.

According to certain embodiments, a case (such as, for example, the case 100) accommodating a hanger tray (such as, for example the tray 200) may include a first side surface (such as, for example, the first case surface 110), a second side surface (such as, for example, the fourth case surface 140) facing the first side surface, a third side surface (such as, for example, the second case surface 120) disposed between the first side surface and the second side surface, a fourth side surface (such as, for example, the third case surface 130) disposed between the first side surface and the second side surface and facing the third surface, a first cover (such as, for example, the fifth case surface 150) that extends from one distal end of the first side surface and covers at least a portion of a first opening (such as, for example, the first opening 511) defined by the first side surface, the second side surface, the third side surface, and the fourth side surface, a second cover (such as, for example, the sixth case surface 160) extending from the other distal end of the first side surface, is defined by the first side surface, the second side surface, the third side surface, and the fourth side surface, and covering at least a portion of a second opening (such as, for example, the second opening 512) formed at a position opposite to the first opening, and a third cover (such as, for example, the extension portion 170) extending from one distal end of the second side surface and is disposed at a position facing the first cover, in which the case surrounds the hanger tray.

According to certain embodiments, the third cover may be folded toward the first opening by a specified angle to at least partially overlap the hanger tray.

According to certain embodiments, the first cover may be folded toward the first opening by a specified angle to at least partially overlap the hanger tray, and at least a portion of the hanger tray may be disposed between the first cover and the third cover.

According to certain embodiments, the first cover may include a first wing portion (such as, for example, the fourth wing portion 152) extending toward the third side surface, and a second wing portion (such as, for example, the fifth wing portion 153) extending toward the fourth side surface. The first wing portion may be inserted between the third side surface and the hanger tray, and the second wing portion may be inserted between the fourth side surface and the hanger tray.

According to certain embodiments, a hanger part of the hanger tray may be exposed to an external environment through the first opening between the first cover and the third cover.

According to certain embodiments, a width of the third cover may be set to be smaller than a width of the second side surface.

It should be understood that certain embodiments of the present document and terms used herein are not intended to limit the technical features described in the present document to specific embodiments and includes various modifications, equivalents, or alternatives of the corresponding embodiment. In connection with the description of the drawings, similar or related components may be designated by similar reference numerals. A singular form of a noun corresponding to an item may include one or more of items unless the relevant context clearly indicates otherwise. In the present document, phrases such as "A or B," "at least one of A and B," "at least one of A or B," "A, B, or C," "at least one of A, B, and C," and "at least one of A, B, or C" may include any one of the items listed together in a corresponding one of the phrases or all possible combinations thereof. Such terms as "first" and "second" or "1st" and "2nd" may be used to simply distinguish a corresponding component from another corresponding component, and does not limit the components in other aspects (such as, for example, importance or order). When it is referenced that a component (such as, for example, a first component) is "coupled with" or "connected with" another component (such as, for example, a second component) with or without the term "operatively" or "communicatively", this means that the component may be connected with the another component directly (such as, for example, in a wired manner), wirelessly, or via a third component.

According to various embodiment, respective components of the above-described components may include one or a plurality of entities, and some of the plurality of entities may be disposed to be separated from the other components. According to certain embodiments, one or more components or operations among the above-described corresponding components may be omitted or one or more other components or operations may be added. Alternatively or additionally, the plurality of components may be integrated into one component. In this case, the integrated component may perform one or more functions of respective components of the plurality of components in a manner that is the same as or similar to the functions performed by the corresponding component among the plurality of components before the integration. According to various embodiment, operations performed by modules, programs, or other components may be executed sequentially, parallelly, repeatedly, or heuristically, one or more of the operations may be executed in a different order or omitted, or one or more other operations may be added.

What is claimed is:

1. A package structure, comprising:

a case including a first surface in which a first opening is formed, a second surface facing the first surface, and side surfaces surrounding an inner space defined between the first surface and the second surface and connected to the first surface and the second surface; and a tray at least partially housed within the inner space of the case, wherein the tray includes:

a first part on which a product is disposed, a second part extending from the first part, the second part at least partially facing the first surface of the case, and a hanger part extending from the second part and extending outwards from the case through the first opening, wherein the case further includes:

a third surface connecting the first surface and the second surface, a fourth surface extending from the third surface, a fifth surface extending from the third surface in a direction opposite to the fourth surface, a sixth surface extending from the fifth surface in a direction opposite to the third surface, and disposed between the fourth surface and the fifth surface, and an extension portion extending from the sixth surface and at least partially facing the second part of the tray, and wherein the second part of the tray is disposed at least partially between the extension portion and the first surface.

2. The package structure of claim 1, wherein when the second surface of the case is open and the tray is moved in a direction toward the second surface of the case, the extension portion of the case folds so as to overlap the sixth surface of the case.

3. The package structure of claim 1, wherein a corner between the extension portion of the case and the sixth surface of the case includes a bend forming a line, so that the extension portion of the case overlaps the sixth surface of the case, when the tray is moved in a direction toward the second surface of the case.

4. The package structure of claim 1, wherein the sixth surface of the case includes at least one protrusion portion formed on one side of a corner between the extension portion of the case and the sixth surface of the case.

5. The package structure of claim 1, wherein the case further includes a wing portion extending from the sixth surface in a direction opposite to the fifth surface, and wherein the wing portion overlaps the fourth surface, and is attached to the fourth surface.

6. The package structure of claim 5, wherein the fourth surface of the case includes an opening portion formed in a portion thereof overlapping the wing portion.

7. The package structure of claim 1, wherein the hanger part includes:

a first hanger hole formed with respect to two hangers; and a second hanger hole formed with respect to one hanger.

8. The package structure of claim 7, wherein a width of the hanger part is set according to a size of the first hanger hole, and wherein a width of the tray is greater than or equal to the width of the hanger part.

9. The package structure of claim 1, wherein the hanger part extends from the second part of the tray in parallel to the first part of the tray.

10. The package structure of claim 1, wherein the tray further includes:

a third part facing the second surface of the case;

a fourth part facing the fourth surface of the case; and a fifth part facing the fifth surface of the case, wherein the first part of the tray faces the third surface of the case.

11. The package structure of claim 10, wherein the tray forms a first recess through the first part, the second part, the third part, the fourth part, and the fifth part, and wherein the extension portion of the case is folded from the sixth surface, so as to be inserted into the first recess.

12. The package structure of claim 11, wherein the third part of the tray includes a recess structure forming a second recess on which the product is disposed.

13. The package structure of claim 12, wherein when the tray moves in a direction toward the second surface of the case, and wherein when the extension portion of the case is folded toward the sixth surface of the case, a size of the extension portion of the case is set such that the extension portion of the case does not contact with the recess structure.

14. The package structure of claim 12, wherein the tray is configured to accommodate an electronic device in the second recess.

15. The package structure of claim 10, wherein the case further includes:

a first wing portion extending from the first surface in a direction toward the fourth surface; and a second wing portion extending from the first surface in a direction toward the fifth surface, wherein the first wing portion of the case is inserted between the fourth surface of the case and the third part of the tray, and wherein the second wing portion of the case is inserted between the fifth surface of the case and the fourth part of the tray.

16. A case accommodating a hanger tray, the case comprising:

a first side surface;

a second side surface facing the first side surface;

a third side surface disposed between the first side surface and the second side surface;

a fourth side surface disposed between the first side surface and the second side surface and facing the third side surface;

a first cover extending from one distal end of the first side surface and covering at least a portion of a first opening, as defined by the first side surface, the second side surface, the third side surface, and the fourth side surface;

a second cover extending from another distal end of the first side surface, as defined by the first side surface, the second side surface, the third side surface, and the fourth side surface, and covering at least a portion of a second opening formed at a position opposite to the first opening; and a third cover extending from one distal end of the second side surface and disposed at a position facing the first cover, wherein the case surrounds the hanger tray.

17. The case of claim 16, wherein the third cover is folded toward the first opening by a specified angle to at least partially overlap the hanger tray.

18. The case of claim 16, wherein the first cover is foldable toward the first opening by a specified angle to at least partially overlap the hanger tray, and wherein at least a portion of the hanger tray is disposed between the first cover and the third cover.

19. The case of claim 16, wherein the first cover includes:

a first wing portion extending toward the third side surface; and a second wing portion extending toward the fourth side surface, wherein the first wing portion is inserted between the third side surface and the hanger tray, and wherein the second wing portion is inserted between the fourth side surface and the hanger tray.

20. The case of claim 16, wherein a hanger part of the hanger tray is exposed to an exterior environment through the first opening, which is disposed between the first cover and the third cover, and wherein a width of the third cover is set to be smaller than a width of the second side surface.

* * * * *